US007258561B2

(12) United States Patent
Fukazawa

(10) Patent No.: US 7,258,561 B2
(45) Date of Patent: Aug. 21, 2007

(54) CONNECTOR HAVING A PIVOTING MEMBER WITH ENHANCED DUST PROOFING

(75) Inventor: Takeki Fukazawa, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/472,648

(22) Filed: Jun. 20, 2006

(65) Prior Publication Data

US 2006/0286843 A1 Dec. 21, 2006

(30) Foreign Application Priority Data

Jun. 20, 2005 (JP) ..... 2005-178666

(51) Int. Cl.
*H01R 13/15* (2006.01)
*H01R 13/62* (2006.01)

(52) U.S. Cl. ..... 439/260; 439/495

(58) Field of Classification Search ..... 439/260, 439/261, 495
See application file for complete search history.

(56) References Cited

U.S. PATENT DOCUMENTS 7,083,454 B2 * 8/2006 Suzuki ..... 439/260
7,094,093 B2 * 8/2006 Nakano et al. ..... 439/495
2006/0089036 A1 * 4/2006 Takai et al. ..... 439/260

FOREIGN PATENT DOCUMENTS

| | | |
|---|---|---|
| JP | 06-082783 | 11/1994 |
| JP | 11-307198 | 11/1999 |
| JP | 2003-297489 | 10/2003 |
| JP | 2004-071160 | 3/2004 |
| JP | 2004-221067 | 8/2004 |
| JP | 2004342426 A * | 12/2004 |

* cited by examiner

*Primary Examiner*—Hae Moon Hyeon
(74) *Attorney, Agent, or Firm*—Abelman, Frayne & Schwab

(57) ABSTRACT

A connector includes contacts having a contact portion, a connection portion, a fulcrum portion, a jointing portion and a pressure receiving portion; a housing having a ceiling portion covering the contact portions of the contacts and an upper wall covering the pressure receiving portions; and a pivoting member having an actuating portion, urging portions, anchoring holes and a cover portion. Pivotal movement of the urging portions between the connection portions and the pressure receiving portions brings the contact portions into contact with a connecting object. Gaps between the tip of the upper wall and the actuating portion and between the upper wall and the tip of the lower part of the pivoting member are made narrow so that the pivotally moving pivoting member does not touch the upper wall of the housing, thereby enhancing dust-proofing and achieving no insertion force for flexible printed circuit board.

8 Claims, 7 Drawing Sheets

CONNECTOR HAVING A PIVOTING MEMBER WITH ENHANCED DUST PROOFING

BACKGROUND OF THE INVENTION

The present invention relates to a connector using a flexible printed circuit board for use in electric and electronic appliances such as flat-screen or thin-shaped plasma televisions, notebook personal computers and the like, and more particularly to a connector superior in dust-proofing.

Connectors used in mobile phones, charge coupled device (CCD) cameras and the like generally include conductors arranged in narrow pitches and are very thin (a so-called lighter, more compact). A connector of one type mainly comprises a housing and contacts, and a flexible printed circuit board is inserted into the housing to force the circuit board into contact with the contacts (a so-called non-zero-insertion force type). A connector of another type mainly comprises a housing, contacts, and a slider, and a flexible printed circuit board is embraced between the housing and a slider (a so-called zero-insertion-force type). Various methods can be considered for embracing the flexible printed circuit board by the housing and the slider. Among them, a construction has been used in many cases, in which after the flexible printed circuit board has been inserted into the housing, the slider is inserted to press the circuit board against the contacts. According to customer's specifications and in order to achieve narrow pitches, it is often required to arrange connection portions of the contacts on the side of a fitting opening of the housing.

The housing is provided with inserting holes for inserting a required number of contacts and with a fitting opening for inserting a flexible printed circuit board. The contacts each mainly comprise a contact portion adapted to contact a flexible printed circuit board, a connection portion to be connected to a substrate, and a fixed portion to be fixed to the housing. The contacts are fixed to the housing by means of press-fitting or the like.

As examples of the zero-insertion-force type, or a so-called rear locking type, incorporated herein are Japanese Patent Application Opened No. 2003-297,489 (Patent Literature 1) and Japanese Patent Application Opened No. H11-307,198 (1999) (Patent Literature 2) and further Japanese Patent Application Opened No. 2004-71,160 (Patent Literature 3) proposed by the applicant of the present application. Moreover, as examples of constructions for locking the flexible printed circuit board, incorporated herein are Japanese Utility Model Application Opened No. H6-82,783 (Patent Literature 4) and Japanese Patent Application No. 2003-422,258 (Patent Literature 5) proposed by the applicant of the present application.

Patent Literature 1

According to the Abstract of the Japanese Patent Application Opened No. 2003-297,489, this invention has an object to provide a connector whose actuator can be operated by a slight force and which can achieve a reliable connection by enlarging movements of contacts by the actuator and further can achieve a reduced overall height of the connector. The actuator comprises cam portions, an actuating portion, and relief grooves therebetween, into which tip portions of spring portions of contacts can be detachably inserted. When the actuator is rotated about a fulcrum through 90° in the clockwise direction, the cam portions cause the spring portions and connecting spring portions of the contacts to be elastically deformed so that a flexible printed circuit board is embraced between protrusions of contact portions, with the result that patterns of the flexible printed circuit board are connected through terminals of the contacts to a printed substrate. An insulator includes a ceiling portion for covering the contact portions of the contacts, and a guiding portion below the ceiling portion on the forward side for inserting the flexible printed circuit board into the connector.

Patent Literature 2

According to the Abstract of the Japanese Patent Application Opened No. H11-307,198 (1999), this invention has an object to provide a connector for a printed circuit board, connecting a plurality of terminals and holding the flexible printed circuit board, which achieves improved operationality and holding performance. The connector includes a housing having an inserting groove for inserting a flexible printed circuit board or the like, a plurality of contacts arranged side by side so as to permit their contact portions to extend into and retract from the inserting groove, and an actuating member having a plurality of cam portions and being pivotally movable between a connecting position and a release position. When the actuating member is in the connecting position, operated portions of the contacts are urged by the cam portions to cause the contact portions to extend into the inserting groove so that the contact portions are pressed against terminals of the flexible printed circuit board or the like, thereby electrically connecting the terminals to the contacts. On the other hand, when the actuating member is in the release position, operated portions of some contacts are urged by the cam portions to cause the contact portions to slightly extend into the inserting groove so that the contact portions abut against the flexible printed circuit board to temporarily hold the circuit board, and the contact portions of the remaining contacts are caused to retract relative to the inserting groove.

Patent Literature 3

According to the Abstract of the Japanese Patent Application Opened No. 2004-71,160, the invention has an object to provide a connector capable of securely pressing a flexible printed circuit board or flexible flat cable against contact portions of contacts by means of a slider without degrading strengths and specifications of respective components, and being superior in operationality, and achieving narrow pitches of conductors and reduced overall height. Disclosed is the connector whose contacts each comprise a contact portion, a connection portion, and an elastic portion and a fulcrum between the contact portion and the connection portion, and the contact portion, the elastic portion, the fulcrum and the connection portion are arranged substantially in the form of a crank. Moreover, the contacts are each provided with a pressure receiving portion extending from the elastic portion at a location facing to the connection portion. The slider is provided with urging portions arranged in a row side by side in its longitudinal direction and is installed on the housing so as to permit the urging portions to be pivotally moved between the connection portions and the pressure receiving portions of the contacts.

Patent Literature 4

According to the Abstract of the Japanese Utility Model Application Opened No. H6-82,783 (1994), this utility model has an object to provide a connector capable of easily anchoring a flexible flat cable by pawls of a slider even with the flexible flat cable having a rigid reinforcement plate attached to its rear face. Disclosed is a connector construction comprising a housing including contact pins therein and formed with a fitting space into which a flat cable is inserted, and a slider mounted on the housing such that the slider can be detachably inserted into the fitting space of the housing and is pivotally movable outside of the housing when the slider is removed from the fitting space, thereby bringing the flat cable into electrical contact with the contact pins by forcing the slider into the fitting space after the flat cable has been inserted into the fitting space, wherein the slider is provided on its flat cable abutting surface with anchoring protrusions adapted to be inserted in and anchored at anchoring portions formed in the flexible cables and formed in a reinforcement plate attached to the rear face of the flexible cable.

Patent Literature 5

In Japanese Patent Application Opened No. 2003-422, 258proposed by the applicant of the present application, disclosed as a construction for locking a flexible printed circuit board is a connector ensuring a required holding force for a flexible printed circuit board, even if the number of conductors is small, without causing any defective connection. According to this invention, the connector to be detachably fitted with a flexible printed circuit board includes a required number of contacts having a contact portion adapted to contact the flexible printed circuit board, and a housing holding and fixing the contacts therein and having a fitting opening into which the flexible printed circuit board is inserted, wherein the flexible printed circuit board is provided with anchoring portions and a locking member having engaging portions adapted to engage the anchoring portions is mounted on the housing so that the flexible printed circuit board is fixed so as not to be removed from the housing by causing the engaging portions of the locking member to be engaged with the anchoring portions of the printed circuit board, and a further reliable locking can be achieved by providing grooves in positions corresponding to the engaging portions.

Patent Literature 6

In the Abstract of Japanese Patent Application No. 2004-307,793 proposed by the applicant of the present application in order to improve dust-proof property, disclosed is a connector with high dust-proofing capability and requiring little or no insertion force for a flexible printed circuit board. The connector includes a required number of contacts, a housing, and a pivoting member, wherein the contacts each comprise at least a contact portion, a connection portion, a fulcrum portion, a jointing portion and a pressure receiving portion, and are substantially H-shaped, and when urging portions of the pivoting member are pivotally moved between the connection portions and the pressure receiving portions to bring the contact portions into contact with a connecting object, and wherein the housing comprises a ceiling portion for covering the contact portions of the contacts and an upper wall for covering the pressure receiving portions of the contacts, and the pivoting member comprises an actuating portion, the urging portions, anchoring holes, and a cover portion which covers the tail portions of the contacts after the pivoting member has been pivoted.

Recently, on proceeding of miniaturization of electric and electronic appliances, the need for miniaturization of connectors has become stronger so that the connectors have increasingly become lighter and more compact. With such a progress of light weight and smaller geometry, connectors whose upper surfaces of contacts (particularly on tail side) are exposed have been widely used in order to obtain an operating space for a pivoting member such as an actuator, slider and the like. Depending upon uses or applications of the connectors, however, there is no need for miniaturization (reduced overall height), and therefore, the dust-proofing of the connector would be degraded by the exposed contacts, which may cause defective or failed electrical connection as the case may be.

Moreover, there is a need for a connector capable of inserting a flexible printed circuit board thereinto with a slight force which is as little as possible. Further, there is a requirement for enabling to visually ascertain whether a flexible printed circuit board has been completely fitted in the connector. Furthermore, sometimes connectors are used under bad circumstances such as dusty environment. According to our customer's specifications, a requirement has become stronger for improving dust-proof property than that of the Patent Literature 6 proposed by the applicant of the present application.

SUMMARY OF THE INVENTION

It is an object of the invention to provide a connector which can fully comply with the requirements particularly recently imposed on connectors and overcome the drawbacks of the prior art and which requires zero insertion force for a connecting object such as a flexible printed circuit board and achieves improved dust-proof property.

The above object can be achieved by the connector 10 according to the invention, which detachably fitted with a connecting object, including a required number of contacts 14 having a contact portion 26 adapted to contact the connecting object, a housing 12 holding and fixing the contacts 14 therein and having a fitting opening 20 into which the connecting object is inserted, and a pivoting member 18 for urging the contacts 14, wherein the contacts 14 each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having an extension portion 36 at one end including a fixed portion 38 to be inserted into the housing 12 and a connection portion 40 at the other end to be connected to a substrate; and a jointing fulcrum 30 for connecting the first and second pieces 22, 24, and the contact portion 26, the jointing fulcrum 30 and the connection portion 40 are arranged substantially in the form of a crank, wherein the housing 12 has a ceiling portion 50 for covering the contact portions 26 of the contacts 14, and an upper wall 52 continuous with the ceiling portion 50 for covering the pressure receiving portions 32 of the contacts, wherein the pivoting member 18 comprises an actuating portion 56 for pivotally moving the pivoting member, urging portions 54 arranged continuously in a longitudinal direction, anchoring holes 58 independent from one another each into which the pressure receiving portion 32 can be inserted and each which engages the projection 42, and an inserting hole 62 into which the upper wall 52 is inserted, and the pivoting member 18 is mounted on the housing 12 so that the urging portions 54 are pivotally moved between the connection portions 40 and the pressure receiving portions 32 of the contacts 14, and wherein in the state that the pivoting member 18 is being pivotally moved to bring the contacts 14 into contact with the connecting object, gaps between the tip of the upper wall 52 and the actuating portion 56 and between the upper wall 52 and the tip of the pivoting member 18 on the opposite side from the actuating portion 56 are made as narrow as possible to an extent such that the pivoting member 18 does not touch the upper wall 52 of the housing 12 when the pivoting member 18 is being pivotally moved.

Even narrower pitches of conductors can be achieved by the connector 10 according to the invention, detachably fitted with a connecting object, including a required number of contacts 14, 16 having a contact portion 26 adapted to contact the connecting object, a housing 12 holding and fixing the contacts 14, 16 therein and having a fitting opening 20 into which the connecting object is inserted, and a pivoting member 18 for urging the contacts 14, 16, wherein the contacts consist of two kinds of contacts 14, 16 arranged alternately staggered, the contacts 14 of the one kind each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having an extension portion 36 at one end including a fixed portion 38 to be inserted into the housing 12 and a connection portion 40 at the other end to be connected to a substrate; and a jointing fulcrum 30 for connecting the first and second pieces 22, 24, and the contact portion 26, the jointing fulcrum 30 and the connection portion 40 being arranged substantially in the form of a crank, and the contacts 16 of the other kind each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having a connection portion 40 at one end to be connected to a substrate and an extension portion 36 at the other end including a fixed portion 38 to be inserted into the housing 12; and a jointing fulcrum 30 for connecting the first and second pieces 22, 24, and the contact portion 26, the jointing fulcrum 30 and the connection portion 40 being arranged substantially in the form of a U-shape, wherein the housing 12 has a ceiling portion 50 for covering the contact portions 26 of the contacts 14, 16 of the one and the other kinds, and an upper wall 52 continuous with the ceiling portion 50 for covering the pressure receiving portions 32 of the contacts 14, 16 of the one and the other kinds, wherein the pivoting member 18 comprises an actuating portion 56 for pivotally moving the pivoting member, urging portions 54 arranged continuously in a longitudinal direction, anchoring holes 58 independent from one another each into which the pressure receiving portion 32 can be inserted and each which engages the projection 42, and an inserting hole 62 into which the upper wall 52 is inserted, and the pivoting member 18 is mounted on the housing 12 so that the urging portions 54 are pivotally moved between the connection portions 40 and the pressure receiving portions 34 32 of the contacts 14 of the one kind, and wherein in the state that the pivoting member 18 is being pivotally moved to bring the contacts 14 into contact with the connecting object, gaps between the tip of the upper wall 52 and the actuating portion 56 and between the upper wall 52 and the tip of the pivoting member 18 on the opposite side from the actuating portion 56 are made as narrow as possible to an extent such that the pivoting member 18 does not touch the upper wall 52 of the housing 12 when the pivoting member 18 is being pivotally moved.

The pivoting member 18 has a substantially U-shaped cross-section, and a gap between the tip of the upper wall 52 and the actuating portion 56 is 0.5 to 0.7 mm and a gap between the upper wall 52 and the tip of the pivoting member 18 on the opposite side from the actuating portion 56 is 0.3 to 0.5 mm, thereby avoiding the pivoting member 18 from touching the upper wall 52 of the housing 12 upon pivotal movement of the pivoting member 18 and improving the dust-proof property of the connector. If the gap between the tip of the upper wall 52 and the actuating portion 56 is less than 0.5 mm, the pivoting member 18 will touch the housing 12 when the former is being pivotally moved. If the gap between the tip of the upper wall 52 and the pivoting member 56 is more than 0.7 mm, the dust-proof property cannot be improved. On the other hand, if the gap between the upper wall 52 and the tip of the pivoting member 18 on the opposite side from the actuating portion 56 is less than 0.3 mm, the pivoting member 18 will touch the housing 12 when the former is being pivotally moved. If the gap is more than 0.5 mm, the dust-proof property cannot be improved.

At least one of the first and second pieces 22, 24 of each of the contacts 14, and the contacts 14, 16 of the one and the other kinds is provided with an inclined portion 28 tilted upwardly away from the fitting opening 20.

As can be seen from the above description, the connector according to the invention can bring about the following significant functions and effects. (1) In the connector 10 detachably fitted with a connecting object, including a required number of contacts 14 having a contact portion 26 adapted to contact the connecting object, a housing 12 holding and fixing the contacts 14 therein and having a fitting opening 20 into which the connecting object is inserted, and a pivoting member 18 for urging the contacts 14, according to the invention that the contacts 14 each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having an extension portion 36 at one end including a fixed portion 38 to be inserted into the housing 12 and a connection portion 40 at the other end to be connected to a substrate; and a jointing fulcrum 30 for connecting the first and second pieces 22, 24, and the contact portion 26, the jointing fulcrum 30 and the connection portion 40 are arranged substantially in the form of a crank, that the housing 12 has a ceiling portion 50 for covering the contact portions 26 of the contacts 14, and an upper wall 52 continuous with the ceiling portion 50 for covering the pressure receiving portions 32 of the contacts, that the pivoting member 18 comprises an actuating portion 56 for pivotally moving the pivoting member, urging portions 54 arranged continuously in a longitudinal direction, anchoring holes 58 independent from one another each into which the pressure receiving portion 32 can be inserted and each which engages the projection 42, and an inserting hole 62 into which the upper wall 52 is inserted, and the pivoting member 18 is mounted on the housing 12 so that the urging portions 54 are pivotally moved between the connection portions 40 and the pressure receiving portions 32 of the contacts 14, and that in the state that the pivoting member 18 is being pivotally moved to bring the contacts 14 into contact with the connecting object, gaps between the tip of the upper wall 52 and the actuating portion 56 and between the upper wall 52 and the tip of the pivoting member 18 on the opposite side from the actuating portion 56 are made as narrow as possible to an extent such that the pivoting member 18 does not touch the upper wall 52 of the housing 12 when the pivoting member 18 is being pivotally moved. According to the invention, therefore, zero insertion force is achieved for a connecting object, and the reduced overall height of the connector of 2.5 mm or less can be achieved. Moreover, as there is little or no gap between the pivoting member and the housing, it is possible to improve the dust-proof property to an extent more than two to three times that of the Patent Literature 6.

(2) In the connector 10 detachably fitted with a connecting object, including a required number of contacts 14, 16 having a contact portion 26 adapted to contact the connecting object, a housing 12 holding and fixing the contacts 14, 16 therein and having a fitting opening 20 into which the connecting object is inserted, and a pivoting member 18 for urging the contacts 14, 16, according to the invention that the contacts consist of two kinds of contacts 14, 16 arranged alternately staggered, the contacts 14 of the one kind each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having an extension portion 36 at one end including a fixed portion 38 to be inserted into the housing 12 and a connection portion 40 at the other end to be connected to a substrate; and a jointing fulcrum 30 for connecting the first and second pieces 22, 24, and the contact portion 26, the jointing fulcrum 30 and the connection portion 40 being arranged substantially in the form of a crank, and the contacts 16 of the other kind each comprise a first piece 22 having the contact portion 26 at one end adapted to contact the connecting object, a pressure receiving portion 32 at the other end adapted to be urged by the pivoting member 18, and a projection 42 extending inwardly from the tip of the pressure receiving portion 32; a second piece 24 having a connection portion 40 at one end to be connected to a substrate and an extension portion 36 at the other end including a fixed portion 38 to be inserted into the housing 12; and a jointing fulcrum 30 for connecting the first and second pieces 22, 24, and the contact portion 26, the jointing fulcrum 30 and the connection portion 40 being arranged substantially in the form of a U-shape, that the housing 12 has a ceiling portion 50 for covering the contact portions 26 of the contacts 14, 16 of the one and the other kinds, and an upper wall 52 continuous with the ceiling portion 50 for covering the pressure receiving portions 32 of the contacts 14, 16 of the one and the other kinds, that the pivoting member 18 comprises an actuating portion 56 for pivotally moving the pivoting member, urging portions 54 arranged continuously in a longitudinal direction, anchoring holes 58 independent from one another each into which the pressure receiving portion 32 can be inserted and each which engages the projection 42, and an inserting hole 62 into which the upper wall 52 is inserted, and the pivoting member 18 is mounted on the housing 12 so that the urging portions 54 are pivotally moved between the connection portions 40 and the pressure receiving portions 32 of the contacts 14 of the one kind, and that in the state that the pivoting member 18 is being pivotally moved to bring the contacts 14 into contact with the connecting object, gaps between the tip of the upper wall 52 and the actuating portion 56 and between the upper wall 52 and the tip of the pivoting member 18 on the opposite side from the actuating portion 56 are made as narrow as possible to an extent such that the pivoting member 18 does not touch the upper wall 52 of the housing 12 when the pivoting member 18 is being pivotally moved. Consequently, narrower pitches of conductors are possible and zero insertion force for a connecting object is achieved. Moreover, the reduced overall height of 2.5 mm or less is possible, while little or no gap between the pivoting member and the housing can improve the dust-proof property to the extent more than two to three times that of the Patent Literature 6.

(3) According to the invention, the pivoting member 18 has a substantially U-shaped cross-section, and a gap between the tip of the upper wall 52 and the actuating portion 56 is 0.5 to 0.7 mm and a gap between the upper wall 52 and the tip of the pivoting member 18 on the opposite side from the actuating portion 56 is 0.3 to 0.5 mm, thereby avoiding the pivoting member 18 from touching the upper wall 52 of the housing 12 upon pivotal movement of the pivoting member 18 and improving the dust-proof property of the connector. Accordingly, as there is little or no gap between the pivoting member and the housing, it is possible to improve the dust-proof property to the extent more than two to three times that of the Patent Literature 6.

(4) At least one of the first and second pieces 22, 24 of each of the contacts 14, and the contacts 14, 16 of the one and the other kinds is provided with an inclined portion 28 tilted downwardly seen from the fitting opening 20. Therefore, it achieves a reduced overall height of the connector of 2.5 mm or less.

The invention will be more fully understood by referring to the following detailed specification and claims taken in connection with the appended drawings.

DESCRIPTION OF THE PREFERRED EMBODIMENTS

Figure 1A:
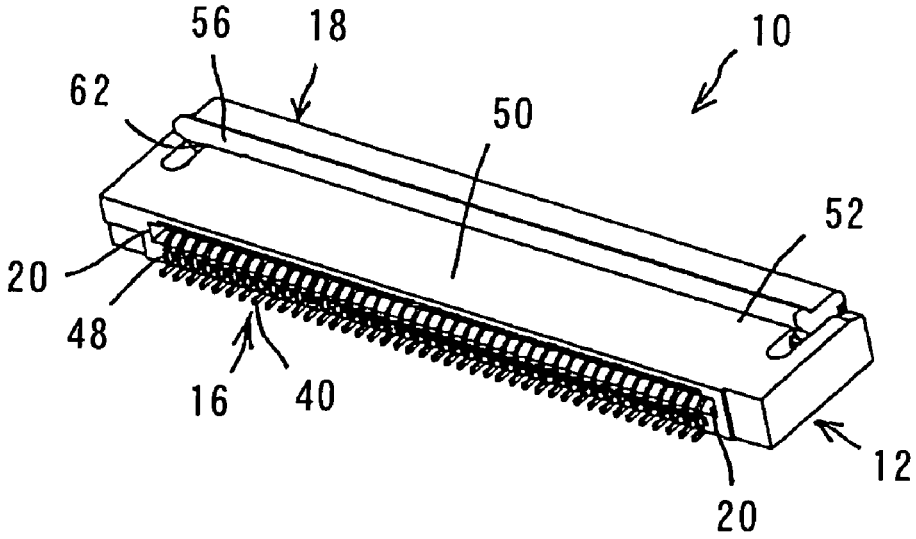
FIG. 1A is a perspective view of a connector according to the invention with a pivoting member opened, viewed from the fitting opening for a flexible printed circuit board.
Figure 1B:
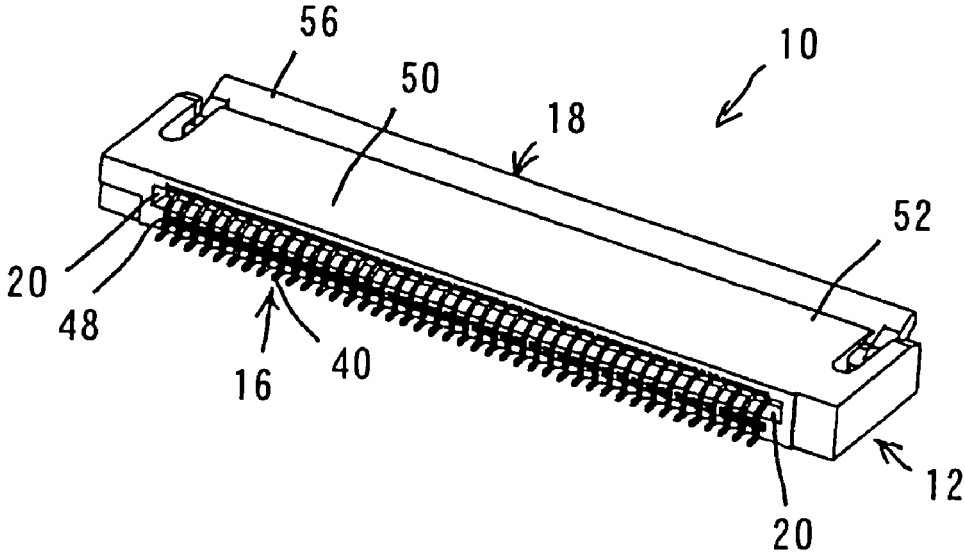
FIG. 1B is a perspective view of the connector shown in FIG. 1A with the pivoting member closed.
Figure 2:
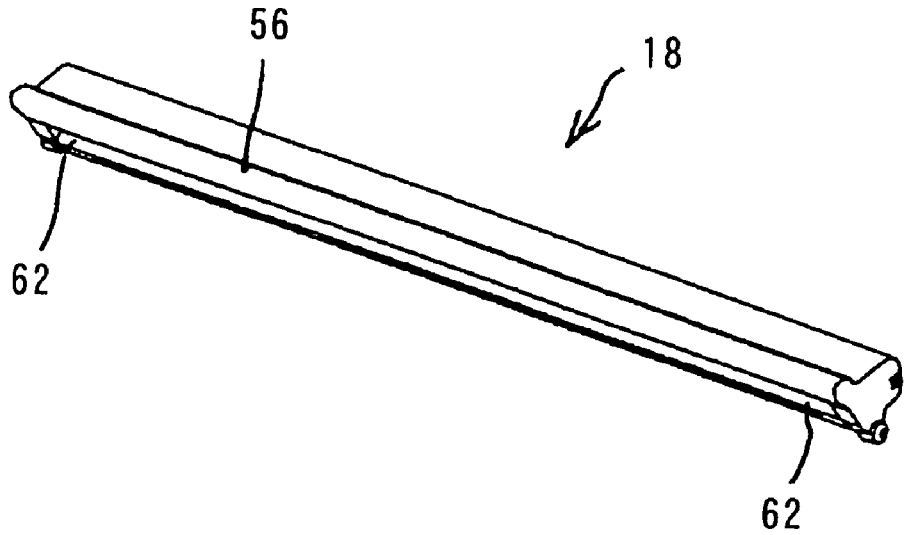
FIG. 2 is a perspective view of the pivoting member.
Figure 3:
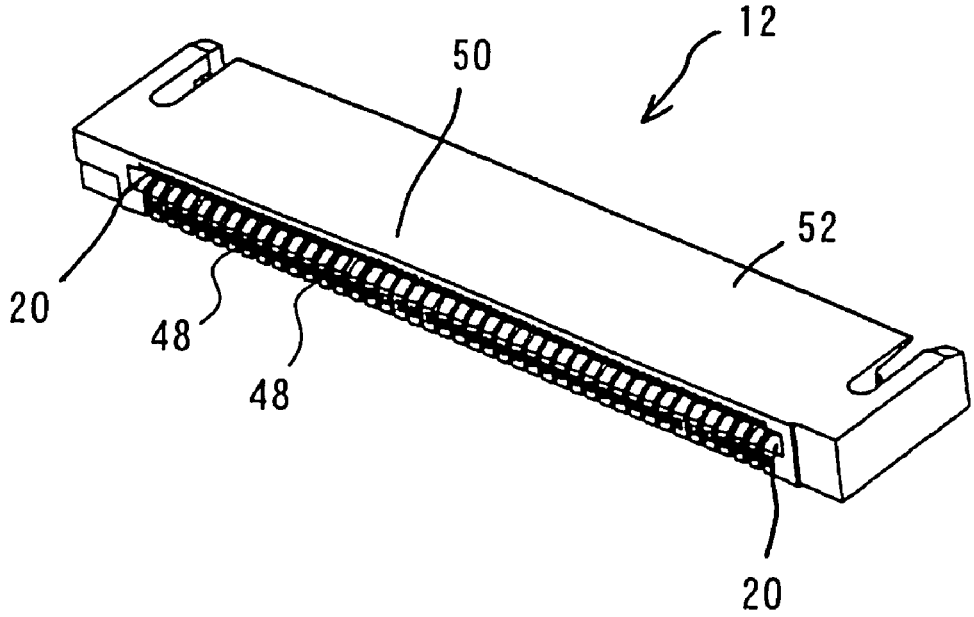
FIG. 3 is a perspective view of the housing.
Figure 4A:
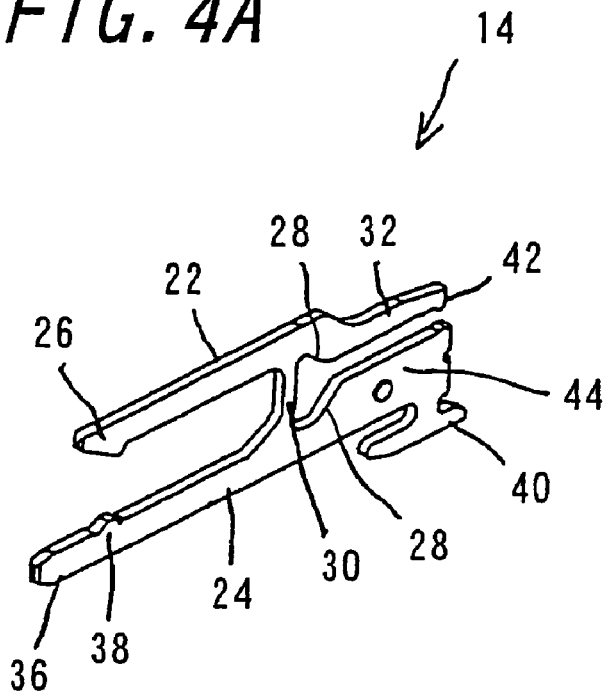
FIG. 4A is a perspective view of a contact of one kind.
Figure 4B:
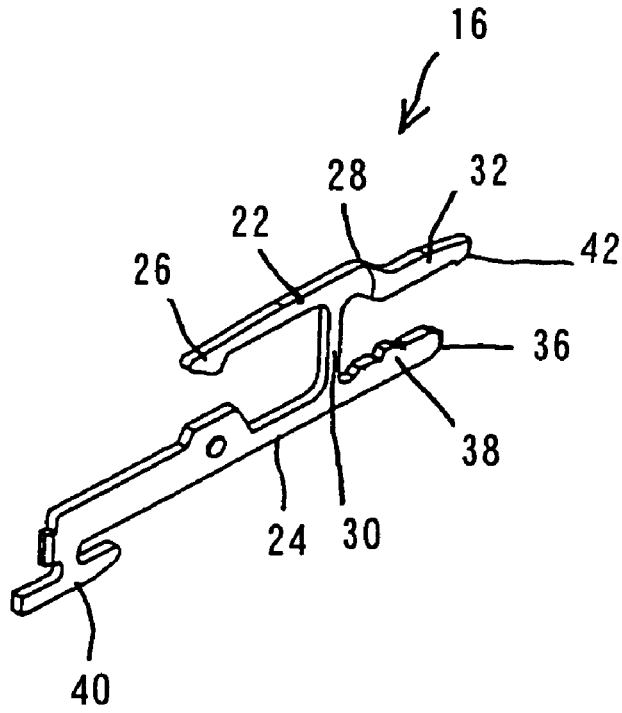
FIG. 4B is a perspective view of a contact of the other kind.
Figure 5A:
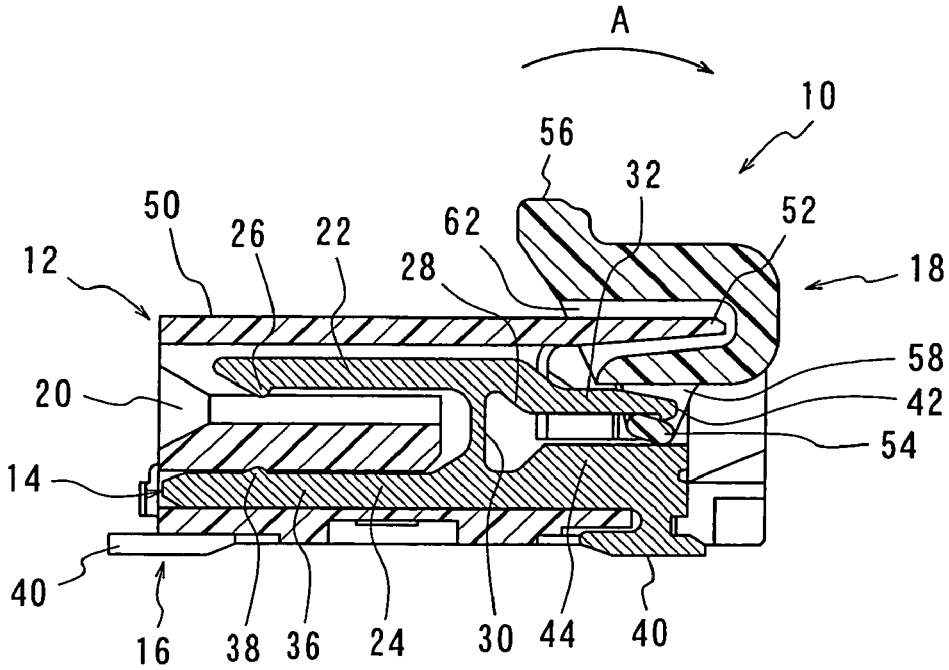
FIG. 5A is a sectional view of the connector with the pivoting member opened, taken along the one contact of the one kind.
Figure 5B:
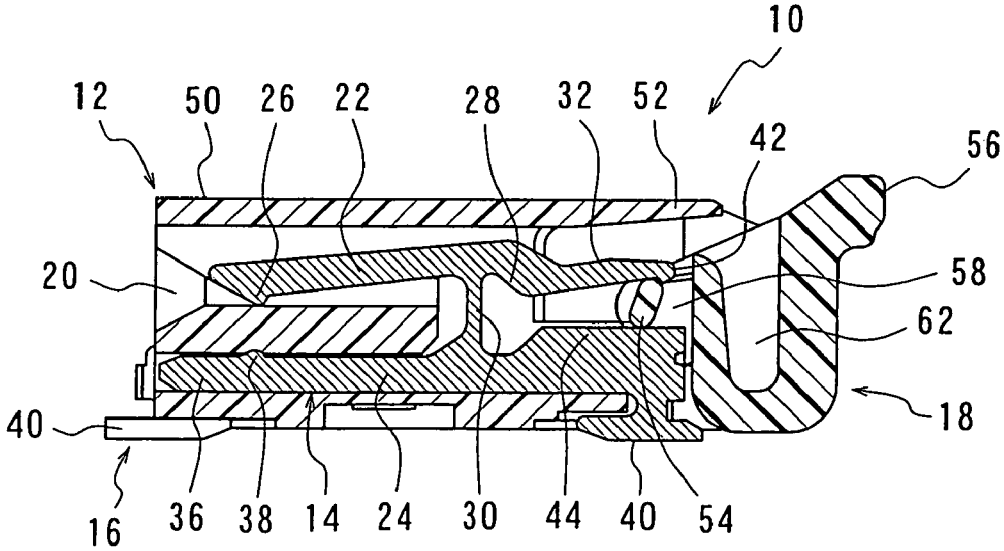
FIG. 5B is a sectional view of the connector with the pivoting member closed, taken along the one contact of the one kind.
Figure 6A:
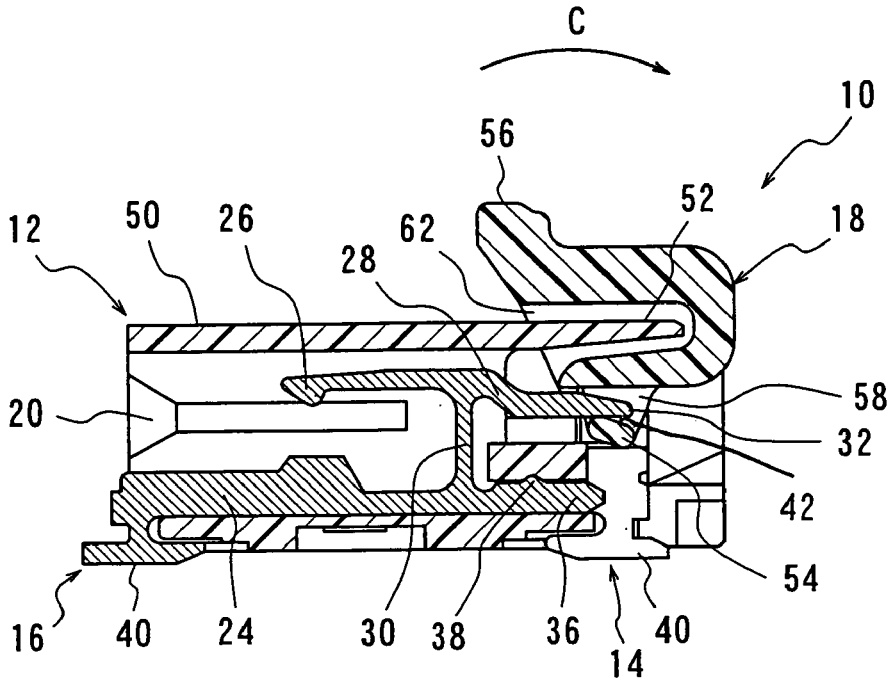
FIG. 6A is a sectional view of the connector with the pivoting member opened, taken along the one contact of the other kind.
Figure 6B:
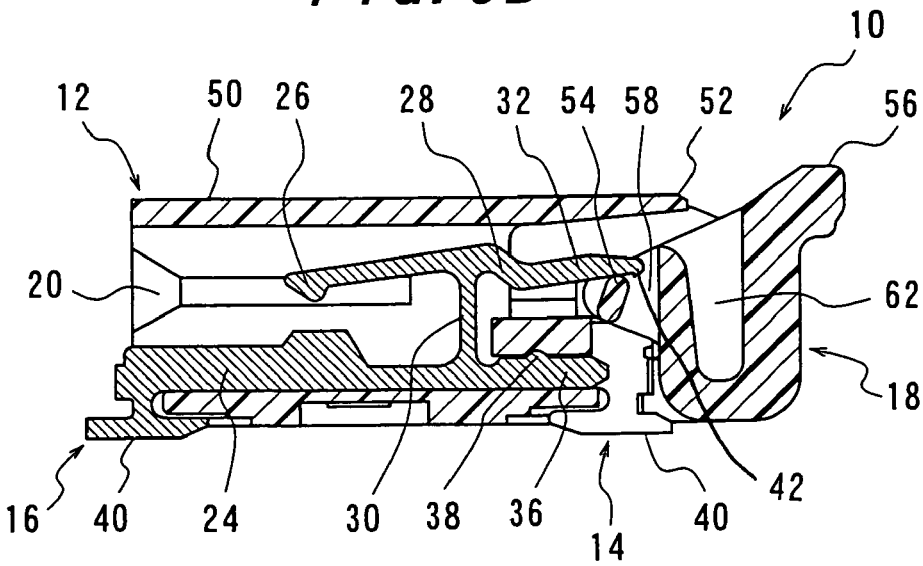
FIG. 6B is a sectional view of the connector with the pivoting member closed, taken along the one contact of the other kind.
Figure 7A:
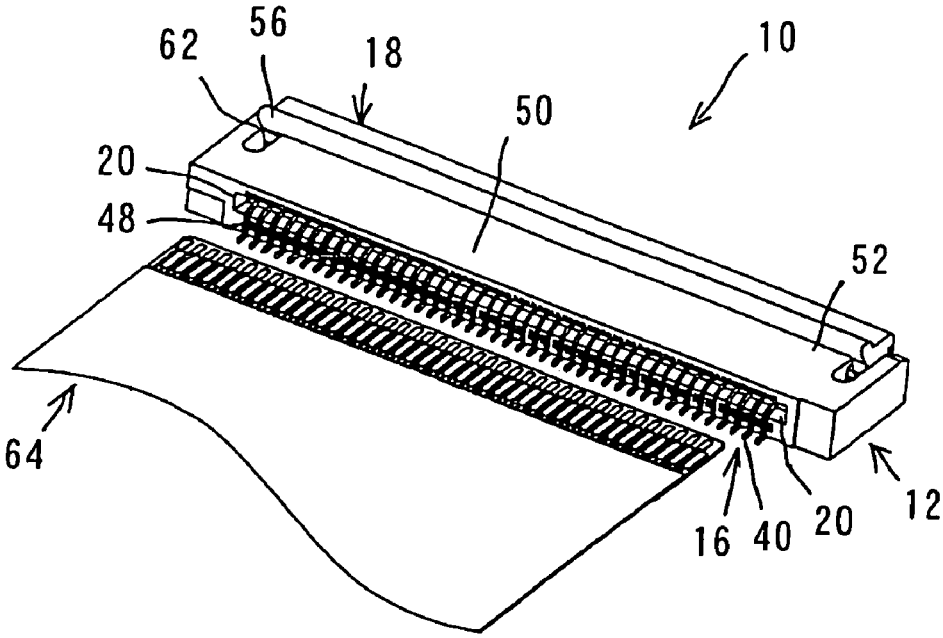
FIG. 7A is a perspective view of the connector and a flexible printed circuit board prior to being inserted.
Figure 7B:
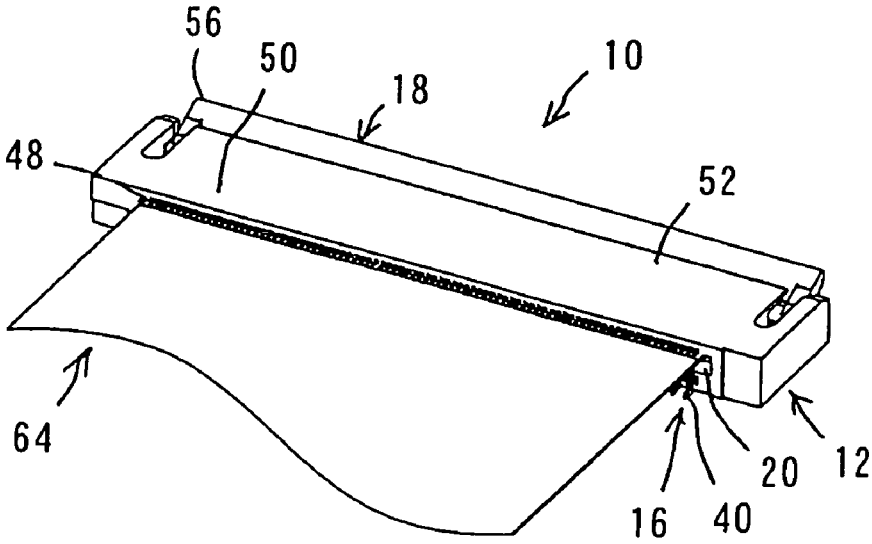
FIG. 7B is a perspective view of the connector and the inserted flexbile printed circuit board.

One embodiment of the invention will be explained with reference to FIGS. 1A to 8E. FIG. 1A is a perspective view of a connector according to the invention with a pivoting member opened, viewed from the side of the fitting opening for a flexible printed circuit board. FIG. 1B is a perspective view of the connector with the pivoting member closed. FIG. 2 is a perspective view of the pivoting member and FIG. 3 is a perspective view of a housing. FIG. 4A is a perspective view of a contact of one kind and FIG. 4B is a perspective view of a contact of the other kind. FIG. 5A is a sectional view of the connector with the pivoting member opened, taken along the contact of the one kind. FIG. 5B is a sectional view of the connector with the pivoting member closed, taken along the contact of the one kind. FIG. 6A is a sectional view of the connector with the pivoting member opened, taken along the contact of the other kind. FIG. 6B is a sectional view of the connector with the pivoting member closed, taken along the contact of the other kind. FIG. 7A is a perspective view of the connector and the flexible printed circuit board prior to being inserted. FIG. 7B is a perspective view of the connector with the flexible printed circuit board inserted. FIGS. 8A to 8E are explanatory views for explaining movements and pivotal movements of urging portions of the pivoting member.

The connector according to the one embodiment of the invention mainly comprises the housing 12, the pivoting member 18, and the contacts 14, 16. The two kinds of contacts 14, 16 are alternately staggered by alternately changing inserting directions of the contacts 14, 16 into the housing 12. By alternately changing the inserting directions of the contacts 14, 16 to arrange these contacts alternately staggered, narrower pitches of conductors and reduced overall height of connector can be achieved.

First, the two kinds of contacts 14, 16 will be explained with reference to FIGS. 4A and 4B. The two kinds of contacts 14, 16 are made of a metal and formed by means of the press-working of the known technique. The metals from which to form the contacts 14, 16 include brass, beryllium copper, phosphor bronze and the like which comply with the requirements such as springiness, electric conductivity and the like.

At the beginning, the contacts 14 of the one kind shown in FIG. 4A will be explained. The contact of the one kind is substantially H-shaped as shown in FIG. 4A and comprises at least a contact portion 26 (shown in the upper part in the drawing) adapted to contact the flexible printed circuit board 64, a connection portion 40 to be connected to a substrate or the like, a fixed portion 38 adapted to be fixed to the housing 12, a jointing fulcrum 30, and a pressure receiving portion 32 adapted to be urged by the pivoting member 18. The contact portion 26 and the pressure receiving portion 32 are arranged at both the ends of a first piece 22 in the form of a substantially crank shaped plate piece, respectively, and the pressure receiving portion 32 is provided at its tip with a projection 42 extending inwardly.

The contact of the one kind further comprises a second piece 24 including at one end an extension portion 36 having the fixed portion 38 adapted to be inserted into the housing 12 and at the other end the connection portion 40 to be connected to the substrate, and the first and second pieces 22 and 24 are connected at the substantially mid portions to each other by means of the jointing fulcrum 30. The contact portion 26, the jointing fulcrum 30 and the connection portion 40 are arranged substantially in the form of a crank. The connection portion 40 is provided with a protrusion base 44 extending toward the pressure receiving portion 32 so that an urging portion 54 of the pivoting member 18 is pivotally moved between the pressure receiving portion 32 and the protrusion base 44. In the illustrated embodiment, the contact 14 is provided in the proximity of the jointing fulcrum 30 with an inclined portion 28 tilted upwardly away from the fitting opening 20. A reduced overall height of the connector can be achieved by providing the inclined portion 28. The protrusion base 44 serves to adjust the clearance between the pressure receiving portion 32 and the connection portion 40 in order to achieve stable pivotal movement of the urging portion 54 of the pivoting member 18. Therefore, the extending amount of the protrusion base may be suitably designed in consideration of such a function.

Located positions of the connection portions 40 may be suitably designed in consideration of positions of lands and patterns of the substrate and limited spaces. In other words, the connection portions 40 are arranged on the side facing to the contact portions 26, or on the side facing to the pressure receiving portions 32 according to the requirements or specifications. Moreover, the connection portions 40 are arranged alternately staggered depending on locations of lands. With the contacts 14 of the one kind, the connection portion 40 is arranged on the side facing to the pressure receiving portion 32. The contact portion 26 is in the form of a projection in order to be easily brought into contact with the flexible printed circuit board 64. The connection portion 40 is of a surface mounting type (SMT) in the illustrated embodiment, but it may be of a dip type.

Depending upon a specification of the flexible printed circuit board, a further contact portion 26 may be provided in a manner facing to the first mentioned contact portion 26. In other ward, in this case the contacts each comprise two contact portions 26 between which the flexible printed circuit board 64 is embraced. In the illustrated embodiment, the contact 14 of the one kind is provided with an extension portion 36 extending from the jointing fulcrum 30 in a manner facing to the contact portion 26, and the extension portion 36 is provided thereon with the fixed portion 38 for fixing the contact to the housing 12. The size and shape of the fixed portion 38 may be suitably designed in consideration of holding force for the contact and the strength of the housing 12.

The jointing fulcrums 30 and the pressure receiving portions 32 carry out the following functions when the flexible printed circuit board 64 has been inserted into the fitting opening 20 of the housing 12. After the flexible printed circuit board 64 has been inserted into the fitting opening 20 of the housing 12, upon pivotal movement of the urging portions 54 of the pivoting member 18 between the protrusion bases 44 of the connection portions 40 and the pressure receiving portions 32 of the contacts 14, the pressure receiving portions 32 are raised by the urging portions 54 so that the upper ends of the jointing fulcrums 30 of the contacts 14 are tilted toward the contact portions 26 about the lower ends (the lower ends viewed in FIG. 4A) of the jointing fulcrums 30 of the contacts 14 as fulcrums, thereby pressing the contact portions 26 against the flexible printed circuit board 64. Sizes and shapes of the jointing fulcrums 30 and the pressure receiving portions 32 may be suitably designed to achieve such functions.

Moreover, said pressure receiving portion 32 of the contact 14 is preferably provided at its tip with a projection 42. With such projections 42 of the contacts 14, when the urging portions 54 of the pivoting member 18 are pivotally moved between the pressure receiving portions 32 and the protrusion bases 44 of the connection portions 40 of the contacts 14, the projections 42 are brought into engagement with the anchoring holes 58 of the pivoting member 18, thereby enabling the pivoting member 18 to resist the strong reaction force against the pivotal movement of the pivoting member 18. The size of the projections 42 may be of any one insofar as they can achieve their function and may be suitably designed to an extent such that the projections 42 can engage in anchoring holes of the pivoting member 18.

The contact 16 of the other kind will then be explained. The differences of the contacts 16 of the other kind from the contacts 14 only will now be explained. Similarly to the contacts 14 of the one kind, the contacts 16 of the other kind are H-shaped as shown in FIG. 4B and each comprise mainly a contact portion 26 (on the upper side in the drawing of FIG. 4B) adapted to contact the flexible printed circuit board 64, a connection portion 40 to be connected to the substrate, a fixed portion 38 to be fixed to the housing 12, a jointing fulcrum 30, and a pressure receiving portion 32 having an inwardly extending projection 42 adapted to be urged by the pivoting member 18. The contact portion 26, the jointing fulcrum 30 and the connection portion 40 are arranged substantially in a U-shape. Although the connection portion 40 is of the surface mounting type similarly to that of the contacts 14 of the one kind, it may be of a dip type.

Although the contacts 14 of the one kind and the contacts 16 of the other kind are somewhat different in shape from each other, the difference lies only in the fact that the connection portion 40 of the contact 16 is arranged at the position corresponding to the extension portion 36 of the contact 14, while the extension portion 36 of the contact 16 is arranged at the position corresponding to the connection portion 40 of the contact 14. In more detail, in the contact 14 of the one kind the connection portion 40 is arranged so as to face to the pressure receiving portion 32, and the extension portion 36 is arranged so as to face to the contact portion 26, while in the contact 16 of the other kind the connection portion 40 is arranged so as to face to the contact portion 26, and the extension portion 36 is arranged so as to face to the pressure receiving portion 32. The extension portion 36 of the contact 16 of the other kind is provided with the fixed portion 38 for fixing the contact 16 to the housing 12.

Figure 8A:
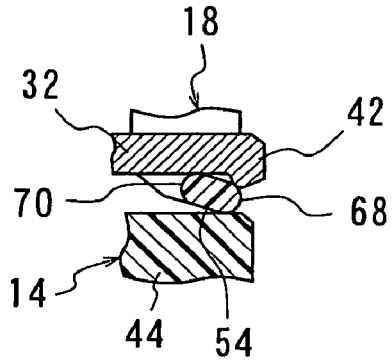
FIGS. 8A to 8E are views for explaining the movements and pivotal movements of urging portions of the pivoting member.

The movements and pivotal movements of the urging portions 54 of the pivoting member 18 will now be explained with reference to FIGS. 8A to 8E. First, in the state that a connecting object and the connector 10 have not been connected, as shown in FIG. 8A the lower end 68 of the urging portion 54 is positioned between the projection 42 of the pressure receiving portion 32 and the protrusion base 44 of the connection portion 40.

Figure 8B:
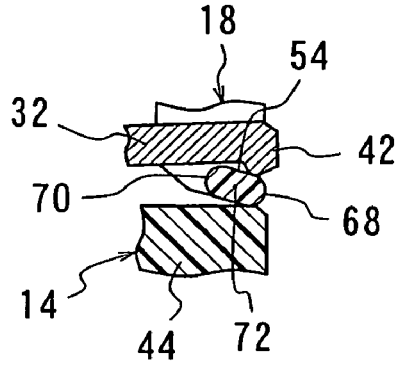

Second, upon pivotally moving the actuating portion 56 of the pivoting member (in the clockwise direction viewed in the drawing), as shown in FIG. 8B the urging portion 54 moves away from the fitting opening 20, and the lower end 68 of the urging portion 54 is embraced between the projection 42 of the pressure receiving portion 32 and the protrusion base 44 of the connection portion 40.

Figure 8C:
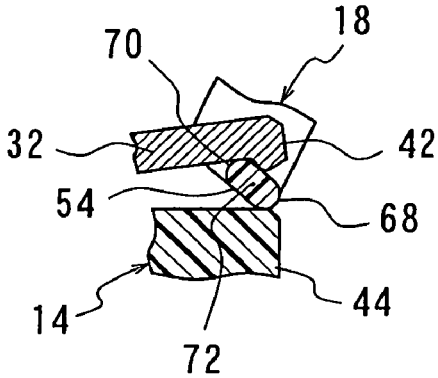

Third, upon further pivotally moving the actuating portion 56 of the pivoting member, as shown in FIG. 8C the urging portion 54 at the second position is pivotally moved about the center of the urging portion 54 as an axis 72 of rotation.

Figure 8D:
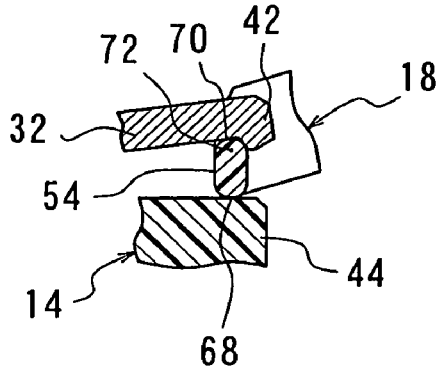

Fourth, upon further pivotally moving the actuating portion 56, as shown in FIG. 8D the urging portion 54 at the third position is pivotally moved about the center of the urging portion 54 as the center 72 of rotation so that the urging portion 54 takes up a substantially vertical position between the pressure receiving portion 32 and the protrusion base 44 of the connection portion 40 and the axis 72 of the rotation moves to a position in the proximity of the upper end 70 in contact with the projection 42.

Figure 8E:
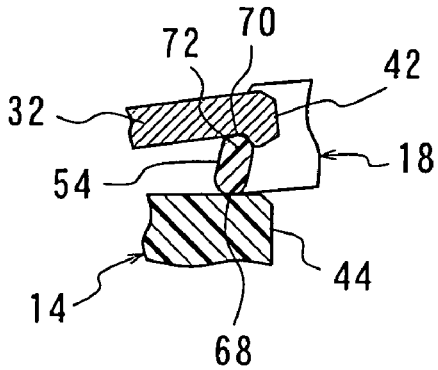

Fifth, upon further pivotally moving the actuating portion 56, as shown in FIG. 8E the urging portion 54 at the fourth position is pivotally moved about a center close to the upper end 70 in contact with the projection 42 so that the urging portion 54 is caused to engage the projection 42 in a state that the urging portion 54 catches on the projection 42.

Namely, the urging portion 54 is initially moved and then pivotally moved, and upon continuing with the pivotal movement, the axis 72 of rotation moves to achieve a compact and space saving pivotal movement (rotation) of the urging portion 54.

In other words, with the connector 10 according to the invention, when a connection object such as the flexible printed circuit board 64 or the like is inserted into the fitting opening 20, no insertion force is required (so-called a zero-insertion force (ZIF) structure). Moreover, the urging portions 54 of the pivoting member 18 are pivotally moved on the side nearer to the projections 42 of the contacts 14, 16 (the pressure receiving portions 32 of the contacts 14, 16 are raised on the side nearer to the projection 42) 50 that the pivoting member 18 can be locked by a slight force, and at the same time, the pressure receiving portions 32 on the side of the projections 42 of the contacts 14, 16 are raised by the urging portions 54 of the pivoting member 18, thereby obtaining high contact forces between the contacts and the connecting object.

The pivoting member 18 will then be explained. The pivoting member 18 is formed from an electrically insulating plastic material by means of the injection molding of the known technique. The materials suitable for the pivoting member 18 are suitably selected in consideration of dimensional stability, workability, manufacturing cost and the like, and generally include polybutylene terephthalate (PBT), polyamide (66PA or 46PA), liquid crystal polymer (LCP), polycarbonate (PC) and the like and combination thereof.

Said pivoting member 18 mainly comprises axles for mounting the pivoting member 18 on the housing 12 to be pivotally movable, the urging portions 54 for urging the pressure receiving portions 32 of the contacts 14, 16, the anchoring holes 58 in which the projections 42 of the contacts 14, 16 engage, and an actuating portion 56. In the illustrated embodiment, the pivoting member 18 has a substantially U-shaped cross-section. The axles are fulcrums for pivotally moving the pivoting member 18, and are suitably fitted in bearings at both the longitudinal ends of the housing 12 for the pivotal movement of the pivoting member 18. There are clearances between the axles and the bearings of the housing 12 so that the axis 72 of rotation moves when the urging portions 54 are pivotally moved as described above. The pivoting member 18 is provided at both the longitudinal ends with locking portions adapted to engage the housing 12 to prevent the pivoting member 18 from being raised in the direction of height (upwardly in the drawing) when the pressure receiving portions 32 of the contacts 14, 16 are urged. The shape and size of the locking portions may be of any ones insofar as they can engage the housing 12, and may be suitably designed in consideration of the above function, and the size and strength of the connector 10.

Said urging portions 54 of the pivoting member 18 serve to urge the pressure receiving portions 32 of the contacts 14, 16, and the shape of the urging portions 54 is preferably an elongated shape and elliptical in the embodiment. With such urging portions having the elliptical cross-section, when the pivoting member 18 is pivotally moved in the direction shown by arrows A and C in FIGS. 5A and 6A so as to pivotally move the urging portions 54 between the pressure receiving portions 32 and the protrusion bases 44 of the connection portions 40 of the contacts 14, 16 so that the pressure receiving portions 32 of the contacts 14, 16 are raised with the aid of the variation in shape of the urging portions 54 such as major or minor axes of the ellipse, thereby pressing the contact portions 26 of the contacts 14, 16 against the flexible printed circuit board 64. The shape of the urging portions 54 may be of any shape insofar as the urging portions 54 can be rotated between the pressure receiving portions 32 and protrusion bases 44 of the connection portions 40 of the contacts 14, 16, and the pressure receiving portions 32 of the contacts 14, 16 can be raised with the variation in size such as major and minor axes of the ellipse.

The shape and size of said urging portions 54 may be suitably designed in consideration of such performances as described above. Moreover, the pivoting member 18 is provided with the actuating portion 56 in consideration of the operationality of the pivoting member 18. Peculiar features are the pivotal movement of the urging portions 54 between the pressure receiving portions 32 and the protrusion bases 44 of only the contacts 14 of the one kind, and the rise of the pressure receiving portions 32 of the contacts 14, 16 of both the kinds to bring the contact portions 26 of the contacts 14, 16 of both the kinds into contact with the flexible printed circuit board 64.

Moreover, when the pivoting member 18 is pivotally moved, the reaction force against the pivotal movement of the pivoting member 18 is very high. In order to resist such a reaction force, the pivoting member 18 is formed with anchoring holes 58 independently from one another with which the projections 42 of the contacts 14, 16 are engaged. The anchoring holes 58 are provided independently from one another to increase the strength of the pivoting member 18 and to prevent the deformation of the pivoting member 18 upon it being pivotally moved.

The pivoting member 18 is mounted to be pivotally movable on the housing 12 on the opposite side from its fitting opening 20 (on the side of the connection portions of the contacts 14 of the one kind).

Moreover, the pivoting member 18 is formed with an inserting hole 62 serving as a relief for the upper wall 52 (later described) of the housing 12. In more detail, the inserting hole 62 prevents the upper wall 52 of the housing 12 from abutting against the pivoting member 18 when it is pivotally moving. The gap between the tip of the upper wall 52 and the actuating portion 56 and the gap between the upper wall 52 and the tip of the pivoting member 18 on the opposite side from its actuating portion 56 are made as narrow as possible within a range to avoid the pivoting member 18 from touching the upper wall 52 of the housing 12 when the pivoting member 18 is being pivotally moved for connecting the contacts 14, 16 to the connecting object. In this manner, as there is little or no gap, the dust-proof property can be improved to the extent more than two to three times that of the Patent Literature 6. In the illustrated embodiment, the gap between the tip of the upper wall 52 and the actuating member 56 is 0.5 to 0.7 mm, while the gap between the upper wall 52 and the tip of the pivoting member 18 on the opposite side from its actuating portion 56 is 0.3 to 0.5 mm.

In the last place, the housing 12 will be explained. The housing 12 is formed from an electrically insulating plastic material by means of the injection molding of the known technique. The materials for the housing 12 are suitably selected in consideration of dimensional stability, workability, manufacturing cost and the like, and generally include polybutylene terephthalate (PBT), polyamide (66PA or 46PA), liquid crystal polymer (LCP), polycarbonate (PC) and the like and combination thereof.

The housing 12 is provided with inserting grooves 48 into which the required number of contacts 14, 16 are installed and fixed thereat by means of press-fitting, hooking (lancing), welding or the like. Moreover, the housing 12 is provided with the fitting opening 20 into which the flexible printed circuit board 64 is inserted. The size of the fitting opening 20 may be suitably designed so that the flexible printed circuit board can be inserted and the pivoting member causes the contacts 14, 16 to be pressed against the flexible printed circuit board 64 inserted into the fitting opening 20. The housing is provided at both the longitudinal ends with the bearings into which the axles of the pivoting member 18 are installed to permit the pivotal movement of the pivoting member 18. The clearances between the axles and the bearings make possible to perform the compact rotation of the urging portions 54 of the pivoting member 18 as described above. The shape and size of the bearings may be of any ones so long as the pivoting member 18 can be pivotally moved to enable the compact rotation of its urging portions 54 and may be suitably designed in consideration of these functions, the strength and size of the housing 12 and the like.

The housing 12 is provided with a ceiling portion 50 for covering the contact portions 26 of the contacts 14, 16 and with the upper wall 52 continuous with the ceiling portion 50 for covering the pressure receiving portions 32 of the contacts 14, 16. The ceiling portion 50 and the upper wall 52 serve to improve the dust-proof property for the contacts 14, 16. Sizes and shapes of the ceiling portion 50 and the upper wall 52 may be suitably designed in consideration of their functions, the strength of the housing 12, the pivotal movement capability and the strength of the pivoting member 18 and the like. In order to achieve a reduced overall height of the connector, the thicknesses of the walls of the housing 12 are made as thin as possible. In the illustrate embodiment, the upper wall 52 is 0.3 mm in thickness, and the lower wall on the opposite side from the upper wall 52 is approximately 0.4 mm in thickness.

The present invention is applicable to connectors using a flexible printed circuit board 64 for use in electric and electronic appliances such as thin-shaped plasma televisions, notebook personal computers and the like, and particularly to connectors with a dust-proofing structure.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector detachably fitted with a connecting object, comprising:

a plurality of contacts, each contact having a contact portion adapted to contact said connecting object, a housing holding and fixing said contacts therein and having a fitting opening into which said connecting object is inserted, and a pivoting member for urging said contacts, wherein said contacts each comprise a first piece having the contact portion at one end adapted to contact said connecting object, a pressure receiving portion at the other end adapted to be urged by said pivoting member, and a projection extending inwardly from the tip of the pressure receiving portion; a second piece having an extension portion at one end including a fixed portion to be inserted into said housing and a connection portion at the other end to be connected to a substrate; and a jointing fulcrum for connecting said first and second pieces, and said contact portion, said jointing fulcrum and said connection portion are arranged substantially in the form of a crank, wherein said housing has a ceiling portion for covering the contact portions of said contacts, and an upper wall continuous with said ceiling portion for covering the pressure receiving portions of said contacts, wherein said pivoting member comprises an actuating portion for pivotally moving said pivoting member, urging portions arranged continuously in a longitudinal direction, anchoring holes independent from one another each into which said pressure receiving portion can be inserted and each which engages said projection, and an inserting hole into which said upper wall is inserted, and said pivoting member is mounted on said housing so that said urging portions are pivotally moved between said connection portions and said pressure receiving portions of said contacts, and wherein in the state that said pivoting member is being pivotally moved to bring said contacts into contact with said connecting object, gaps between the tip of said upper wall and said actuating portion and between said upper wall and the tip of said pivoting member on the opposite side from said actuating portion are made as narrow as possible to an extent such that said pivoting member does not touch said upper wall of said housing when said pivoting member is being pivotally moved.

2. The connector as set forth in claim 1, wherein said pivoting member has a substantially U-shaped cross-section, and a gap between the tip of said upper wall and said actuating portion is in the range of 0.5 to 0.7 mm and a gap between said upper wall and the tip of said pivoting member on the opposite side from said actuating portion is in the range of 0.3 to 0.5 mm, thereby avoiding said pivoting member from touching said upper wall of the housing upon pivotal movement of the pivoting member and improving the dust-proof property of the connector.

3. The connector as set forth in claim 2, wherein at least one of the first and second pieces of each of said contacts is provided with an inclined portion tilted downwardly as seen from said fitting opening.

4. The connector as set forth in claim 1, wherein at least one of the first and second pieces of each of said contacts is provided with an inclined portion tilted downwardly as seen from said fitting opening.

5. A connector detachably fitted with a connecting object, comprising:

a plurality of contacts, each contact having a contact portion adapted to contact said connecting object, a housing holding and fixing said contacts therein and having a fitting opening into which said connecting object is inserted, and a pivoting member for urging said contacts, wherein said contacts consist of two kinds of contacts arranged alternately staggered, said contacts of the one kind each comprise a first piece having the contact portion at one end adapted to contact said connecting object, a pressure receiving portion at the other end adapted to be urged by said pivoting member, and a projection extending inwardly from the tip of the pressure receiving portion; a second piece having an extension portion at one end including a fixed portion to be inserted into said housing and a connection portion at the other end to be connected to a substrate; and a jointing fulcrum for connecting said first and second pieces, and said contact portion, said jointing fulcrum and said connection portion being arranged substantially in the form of a crank, and said contacts of the other kind each comprise a first piece having the contact portion at one end adapted to contact said connecting object, a pressure receiving portion at the other end adapted to be urged by said pivoting member, and a projection extending inwardly from the tip of said pressure receiving portion; a second piece having a connection portion at one end to be connected to a substrate and an extension portion at the other end including a fixed portion to be inserted into said housing; and a jointing fulcrum for connecting said first and second pieces, and said contact portion, said jointing fulcrum and said connection portion being arranged substantially in the form of a U-shape, wherein said housing has a ceiling portion for covering the contact portions of said contacts of the one and the other kinds, and an upper wall continuous with said ceiling portion for covering the pressure receiving portions of said contacts of the one and the other kinds, wherein said pivoting member comprises an actuating portion for pivotally moving said pivoting member, urging portions arranged continuously in a longitudinal direction, anchoring holes independent from one another each into which said pressure receiving portion can be inserted and each which engages said projection, and an inserting hole into which said upper wall is inserted, and said pivoting member is mounted on said housing so that said urging portions are pivotally moved between said connection portions and said pressure receiving portions of said contacts of the one kind, and wherein in the state that said pivoting member is being pivotally moved to bring said contacts into contact with said connecting object, gaps between the tip of said upper wall and said actuating portion and between said upper wall and the tip of said pivoting member on the opposite side from said actuating portion are made as narrow as possible to an extent such that said pivoting member does not touch said upper wall of said housing when said pivoting member is being pivotally moved.

6. The connector as set forth in claim 5, wherein said pivoting member has a substantially U-shaped cross-section, and a gap between the tip of said upper wall and said actuating portion is in the range of 0.5 to 0.7 mm and a gap between said upper wall and the tip of said pivoting member on the opposite side from said actuating portion is in the range of 0.3 to 0.5 mm, thereby avoiding said pivoting member from touching said upper wall of the housing upon pivotal movement of the pivoting member and improving the dust-proof property of the connector.

7. The connector as set forth in claim 6, wherein at least one of the first and second pieces of each of said contacts and said contacts of the one and the other kinds is provided with an inclined portion tilted downwardly as seen from said fitting opening.

8. The connector as set forth in claim 5, wherein at least one of the first and second pieces of each of said contacts and said contacts of the one and the other kinds is provided with an inclined portion tilted downwardly as seen from said fitting opening.

* * * * *